US005843327A

United States Patent [19]

Lindgren

[11] Patent Number: 5,843,327

[45] Date of Patent: Dec. 1, 1998

[54] CASTING MOLD DEVICE

[76] Inventor: Håkan Lindgren, Hagavagen 3, Köping, Sweden

[21] Appl. No.: 573,869

[22] Filed: Dec. 18, 1995

Related U.S. Application Data

[63] Continuation of Ser. No. 107,731, filed as PCT/SE91/00553 published as WO92/03626 Mar. 5, 1992, abandoned.

[30] Foreign Application Priority Data

Aug. 21, 1990 [SE] Sweden ..... 9002154

[51] Int. Cl.[6] ..... E04G 11/00

[52] U.S. Cl. ..... 249/210; 249/219.1; 249/219.2

[58] Field of Search ..... 249/189, 207, 249/210, 219.1, 219.2; 264/31

[56] References Cited

U.S. PATENT DOCUMENTS

| | | | |
|---|---|---|---|
| 1,211,812 | 1/1917 | Barnes | 249/210 |
| 1,413,693 | 4/1922 | Venable | 249/219.2 |
| 1,552,913 | 9/1925 | Danielson | 249/210 |
| 1,560,494 | 11/1925 | Trester | 249/219.2 |
| 2,058,268 | 10/1936 | Stanley | 249/210 |
| 2,313,880 | 3/1943 | Leggett, Sr. | 249/34 |
| 2,451,951 | 10/1948 | Howat | 249/219.2 |
| 2,511,584 | 6/1950 | Hill | 249/219.2 |
| 2,738,563 | 3/1956 | Steele | 249/195 |
| 4,290,985 | 9/1981 | Barale | 249/219.2 |
| 5,069,418 | 12/1991 | Jennings | 249/210 |

FOREIGN PATENT DOCUMENTS

| | | |
|---|---|---|
| 1175132 | 5/1957 | France . |
| 0104388 | 2/1942 | Sweden . |
| 0111621 | 6/1944 | Sweden . |
| 0462988 | 9/1990 | Sweden . |
| 0489681 | 10/1970 | Switzerland . |
| 696260 | 9/1951 | United Kingdom . |
| 9015909 | 12/1990 | WIPO . |

*Primary Examiner*—James P. Mackey
*Attorney, Agent, or Firm*—Browdy and Neimark

[57] ABSTRACT

A casting mould device for casting concrete and similar, e.g., base plates, walls, columns, recesses and similar, having a number of transverse supports (3) with essentially triangular shape with a post (4) which is connected to a base part (5), and preferably a force transferring brace part (6) extending between the post and the base part, the posts of the transverse supports carrying a mould space delimiting element, preferably with the aid of a number of support beams (1) which are fastened to the transverse supports, the base parts transferring the mould pressure exerted on the mould space delimiting element in the casting operation, onto a base against which the base parts apply.

10 Claims, 8 Drawing Sheets

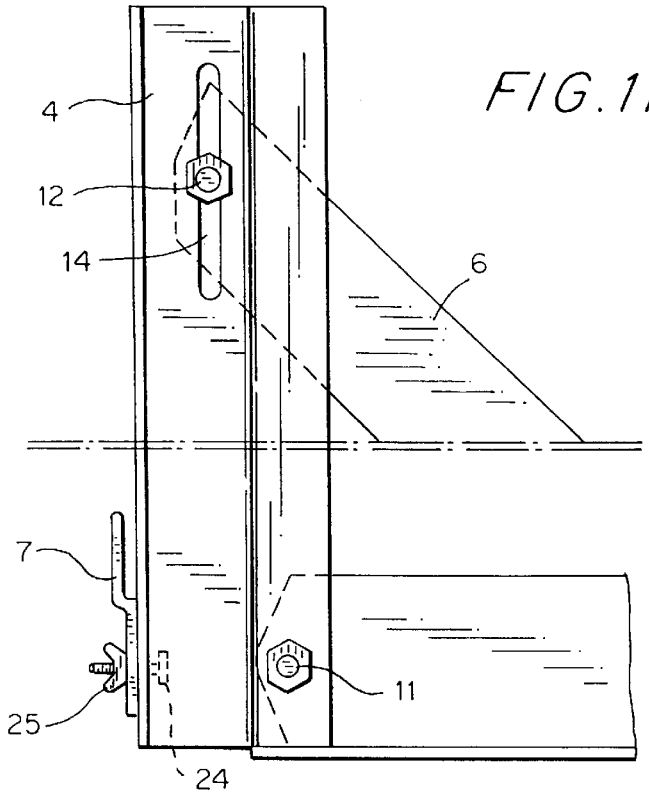
FIG. 11
FIG. 12
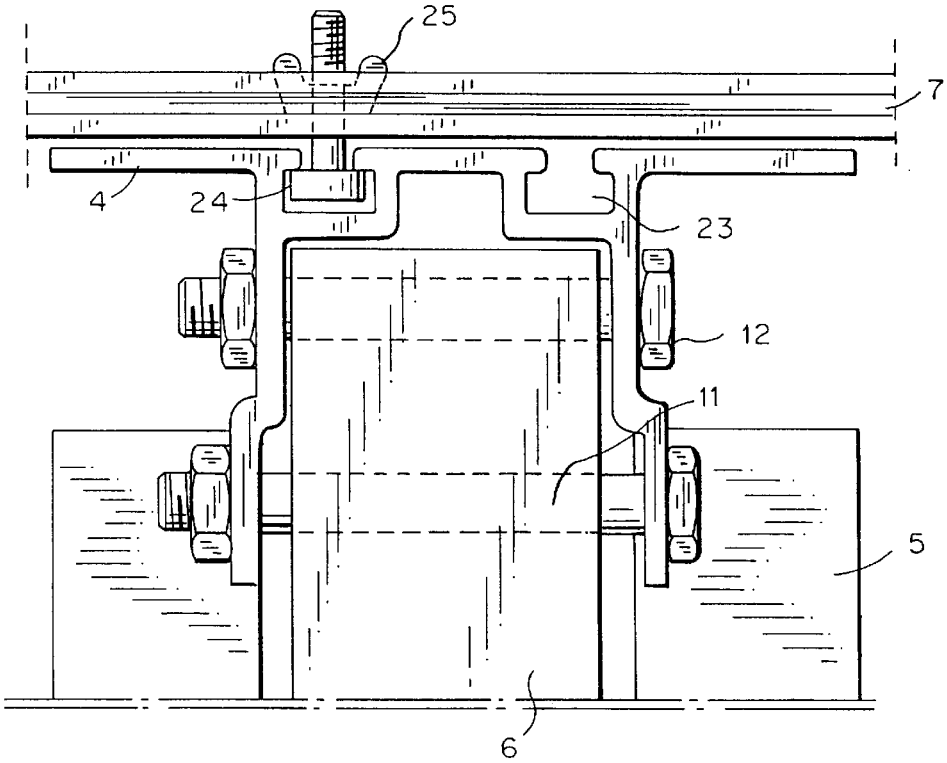

CASTING MOLD DEVICE

This application is a continuation of application Ser. No. 08/107,731, filed as PCT/SE91/00553 published as WO92/03626 Mar. 5, 1992, now abandoned.

BACKGROUND OF THE INVENTION

TECHNICAL FIELD OF THE INVENTION

This invention is related to a casting mould device which is suited for casting concrete and similar, especially for making base plates, columns, column footings, walls and similar, and also for recesses in walls and similar, e.g. for windows, doors and similar, and for stop ends for arches and structural floors, stop ends in lift wells and similar.

SUMMARY AND OBJECTIVES OF THE INVENTION

The device is especially suited for low moulds with a height of up to 1.5 m, especially up to 1.2 to 1.0 m or less, e.g. up to 0.8 or 0.6 m or in some cases up to 0.4 m, and usually with a height of at least 0.15 m or 0.25 m.

The casting mould device according to this invention comprises according to an embodiment one or more support beams, also denoted horizontal beams, which are suited for carrying or supporting shuttering panels or parts of shuttering panels or similar casting mould surface forming elements and which preferably are arranged essentially parallel to said mould surfaces, and transverse supports, also denoted vertical supports, for said support or horizontal beams. Said transverse supports (vertical supports) are preferably arranged essentially perpendicular to the support beam(s) and the mould surface resp. and are intended to transfer the mould pressure, e.g. the pressure of the cast concrete, to a base or anvil, such as the ground or a wall etc. Said transverse supports (vertical supports) have preferably essentially triangular shape comprising a post, which is normally arranged parallel to the mould surface forming element, such as a shuttering panel or similar, or optionally carries directly the element forming the mould surface. Said post is usually arranged with its longitudinal direction extending essentially vertically, but may also be arranged in a direction which deviates e.g. up to 45 degrees, preferably up to 30 degrees or up to 15 degrees from the horizontal plane, e.g. for supporting a mould bottom surface.

The post is connected to a base part, also denoted bottom part, of said transverse support, to which the mould pressure is transferred from the post and from which the mould pressure is transferred to a base, preferably the ground or optionally a wall or another force supporting body. The mould pressure is preferably transferred to said base part with a brace (strut) extending from said post to said base part, preferably from the upper part of the post to the section or end of the base part which is remote from the post. More than one brace can be used, e.g. in case the post is very long and a high casting mould exerting a high casting pressure is to be supported, e.g. a height above 1 m and preferably above 1.5 or 2 m. The base part, as well as the post, preferably has elongated shape with a length which is several times its breadth. The base part (bottom part) can be secured to the base in various ways, e.g. by being provided with holes or openings or other means for fastening with e.g. bolts, bars, nails, etc.

The post and the base part are fixedly or releasably and/or pivotably connected to each other at one end of said elements, preferably with a bolt joint or a similar means which makes possible a rotating motion of said parts in relation to each other in a plane. This is suitably achieved by bonding said parts together with a bolt or a similar joint which is pivotable in one plane, whereby a suitable angle between the post and the base part can be achieved by joining one end or both ends of said brace pivotably or displacably to the post and base part resp. The angle between the post and the base part may e.g. be varied with up to 60 degrees, preferably up to 45 degrees or up to 30 degrees or 15 degrees from a straight angle, in one direction or in both directions.

It is usually suitable to use at least two support beams (horizontal beams) connected to at least two transverse supports (vertical supports), but a larger number of beams and supports may, of course, be used when required.

The support beams are preferably straight for supporting flat surfaces, but also curved beams can be used for supporting curved mould surfaces.

A suitable profile of the support beams (horizontal beams) is a Z-profile which permits uncomplicated fastening to the posts and uncomplicated fastening of the shuttering panels or other mould surface forming elements to the support beams.

The expression "Z-profile" may also comprise other profiles in which the shape of the Z-profile is comprised, e.g. H-profile, h-profile, etc. As an alternative it is also possible to use other beam profiles which permit fastening to the transverse supports and fastening of shuttering panels or other mould surface forming elements, such as U-beams, preferably with a more narrow flange facing and fastened to the transverse supports and a broader flange facing a shuttering panel or similar means fastened to said flange.

The fastening means for joining the support beams to the transverse supports may for Z-beams and similar form a vertical gap adjacent the post into which a flange of the beam can be pushed down. The fastening means may be fixedly joined to the post or stepwise or continuously (stepless) displacable in the longitudinal direction thereof and may be arranged for being locked in a desired position, e.g. be arranged for being fastened or snapped into openings arranged at various levels along the post. Preferably the fastening means for the support beams are arranged for being braced to the post with bolt joints, e.g. with fly nuts and with the bolt displacable in grooves extending in the longitudinal direction of the post, e.g. grooves which extend through the surface of the post facing the mould surface.

The posts are preferably provided with fastening means for the support beams on the side which is remote from the base part, but may also be provided with fastening means on other sides, i.e. directed in another angle than 180 degrees in relation to the base part. The fastening means may also be arranged pivotable around the post for being directed in a desired angle in relation to the base part.

The support beams may be freely displacable in their longitudinal direction thereof in relation to the fastening means on the transverse supports but may also be arranged for being locked in the fastening means against displacement in the longitudinal direction of the beams and/or in the longitudinal direction of the post, e.g. with screws or other locking means.

Support beams which carry mould surface parts which are directed in an angle in relation to each other, e.g. in an angle of 90 degrees at a corner, may be locked to each other in various ways, e.g. with a V-profile shaped part with the same angle between the legs of the V-profile as between the support beams. Fastening may be achieved with a screw which is screwed through the V-profile and the ends of the support beams, or in any other suitable way. In case the distance between two opposite support beam-transverse support units is short those support beams which interconnect said units may be held only by being fastened to the ends of said two first-mentioned support beams, i.e. the transverse supports for said interconnecting support beams may be omitted.

The size of the support beams (horizontal beams) can be selected with regard to occuring loads. For Z-beams, especially of aluminum and alloys thereof, a breadth of the central flange of 5–20 cm, preferably up to 15 or up to 10 cm, e.g. at least 8 cm but often also about 6–7 cm may be suitable, and for the outer flanges from 2 cm up to 10 cm, e.g. about 2–3 cm or also at least 5 cm may be suitable. The thickness may be at least 1 or at least 2 mm and usually up to 10 mm or preferably up to 5 mm. For support beams made from steel, preferably galvanized steel, a smaller breadth of the outer flanges, i.e. the flanges which are fastened to the vertical supports and the mould surface element resp. may be used, e.g. up to 8 cm or preferably up to 5 cm or up to 3 cm and usually at least 1 cm. The breadth of the central flange may suitably be selected to up to 8 cm or up to 5 cm and usually at least 3 cm. The thickness may suitably be selected to at most 5 mm, preferably at most 3 mm or at most 2 mm and usually at least 0.5 mm. The distance between the transverse supports is usually selected to at least 1 m, often at least 1.5 m to 2 m or more, but frequently a distance of at most 3 m, at most 2 m or at most 1 m is suitable.

According to a further embodiment of the invention the casting mould support device is used for arranging window reveal elements in window openings and for arranging door (structural) reveal elements in door openings as mould surface forming walls. Said reveal elements suitably have a breadth which corresponds to the distance between a pair of mould surfaces for a wall which is to be provided with window and door openings resp., and are intended for being cast into the wall. Said reveal elements may suitably be made e.g. from isolating materials, especially plastic foams or similar, which are coated with a concrete material or plastics material or metal sheet, e.g. a layer of fibre containing concrete which can be sprayed onto the isolating material core. A suitable thickness of said reveal elements may e.g. be from 1 or 2 cm up to 20 cm, up to 10 cm or up to 5 cm, e.g. about 3 cm. Of said thickness the core of isolating material may comprise the main part with a thickness of the layer of concrete, fibre enforced concrete, etc. of e.g. at least 1 mm, at least 2 mm or at least 5 mm and often at most 50 mm, at most 20 mm or at most 10 mm. In or close to said reveal elements window frames or door frames resp. may be fastened. The reveal elements may preferably be provided with means for fastening thereof to the wall reinforcement, such as loops or similar. Said reveal elements have suitably an essentially rectangular cross-section shape, the main part of which is comprised by a core of isolating material with essentially rectangular cross-section surrounded by an outer layer of the type mentioned above, e.g. fibre concrete, preferably with essentially homogenous thickness, which forms the surface facing the window or door opening resp., which surface may exhibit a suitable surface smoothness or may be a finished surface. The surface of the reveal element facing the casting mould and the concrete may mainly be free from said outer layer so that at least a part of the surface of the isolating material core is exposed towards the mould and the concrete cast into the mould. The isolating material core may, however, also be omitted entirely and substituted with a cavity or with another material, such as concrete. The reveal elements are preferably pre-fabricated as strands which are cut to a suitable length and inserted into the mould. The reveal elements may be fastened to the support beams of the device according to the invention or directly to the transverse supports or alternatively be arranged and fastened in another suitable way. The reveal elements may also be provided with internal stiffening or strutting means, e.g. in the shape of flanges extending in the longitudinal direction which increase the stiffness against the force exerted by the cast concrete on the reveal elements so that said elements maintain a sufficiently straight shape in the casting operation. By cutting the ends of said pieces of a reveal element string in 45 degrees angle said parts may be brought together to form a mould stop end with 90 degrees angle between the parts, e.g. to form a door or window opening.

BRIEF DESCRIPTION OF THE DRAWINGS

On the enclosed drawings the following is shown:

FIGS. 4–12 disclose examples of various embodiments of transverse supports and parts thereof;

FIG. 17 discloses an embodiment for casting of e.g. an arch (floor) or similar.

DETAILED DESCRIPTION OF THE PREFERRED EMBODIMENT(S

Figure 1:
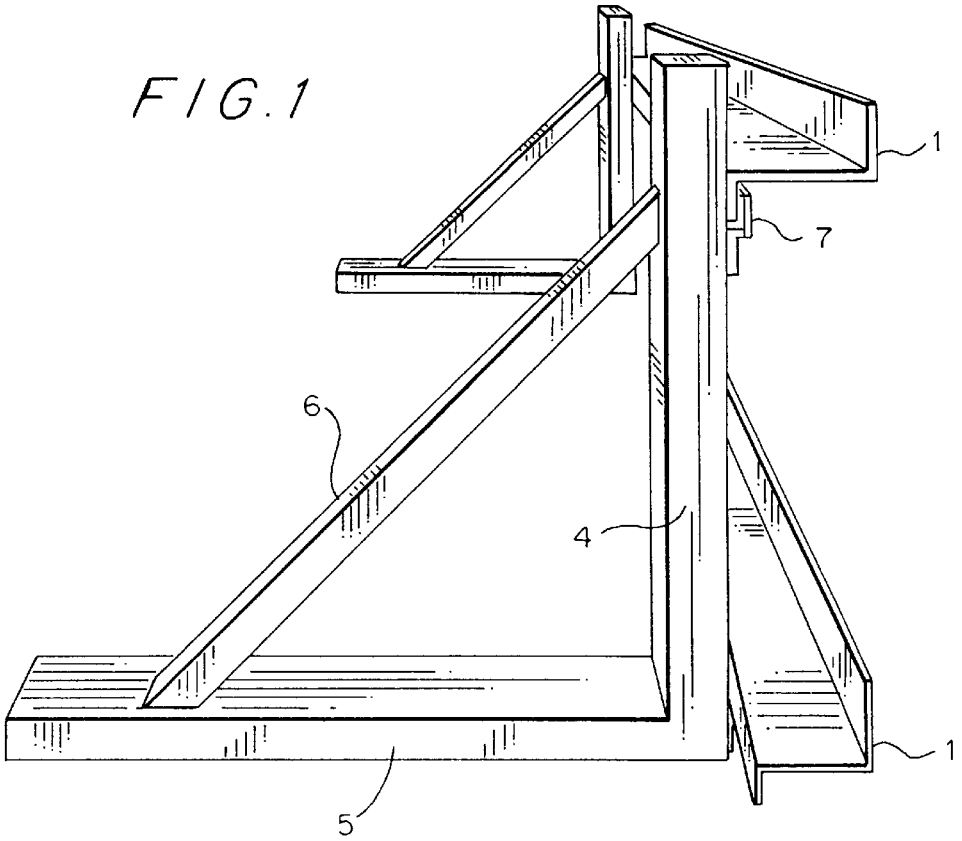
FIG. 1 discloses a casting support device according to the invention with two transverse supports 3 in which two horizontal beams (Z-beams) 1 are held with fastening means 7.

On the enclosed drawings there is thus disclosed, mainly schematically, embodiments of this invention with support beams (horizontal beams) 1 with Z-profile shape, triangular transverse supports (vertical supports) 3 with a post 4, a base part (bottom part) 5 and a brace part 6, fastening means 7 for support beams, flanges 8 on said post and flanges 9 on said bottom part, joining means 10, 11 and 12 for said transverse support parts, e.g. bolts, preferably for pivotably joining said transverse support parts, means for setting the angle between the post and the base part, such as slots 13, 14 for displacing bolts or locking means 10 and 12 resp., or a slot 32 in a base part 5 with a through bolt 35 for locking the end of the brace to the base part 5. There are also shown under-cut grooves 23 arranged in the post, in which the heads of bolts 24 for fastening the fastening means 7 can be displaced and fastened, said bolts being provided with fly nuts 25. There are also disclosed adjustable fastening means 7 which can be displaced along the post 4 and which are urged against the front side of the post 4 with fastening bolts 24 and nuts 25 so that said bolt-nut joint means exerts a pressure against a part of the post 4 with the aid of clamping parts 29 which extend beyond and optionally behind a portion of the sides of the post, and optionally spring means 30 for resilient fastening so that the fastening means 7 can be displaced along the post and thereafter optionally locked.

A preferred profile shape of the post 4 and the base part 5 is a strip shaped profile with two flanges 8 and 9 resp. extending in the longitudinal direction of said strip on one side of the strip in straight angle to said surface, the distance between the inner sides of said flanges of one of said parts preferably being larger than the distance between the outer sides of the flanges of the other of said parts, so that said parts can be joined to each other with a through bolt which extends through openings in the flanges and preferably is used for forming a hinge or link which permits a mutual rotating movement of said parts. The post and base can be formed as an elongated beam with a flat surface facing the transverse support beams and the supporting base respectively. The brace 6 which connects said parts may suitably have the shape of a U-beam which e.g. may have the same outer flange distance as one of said parts.

The wall thickness of the post 4, the bottom part 5 and the brace part 6, having various profiles, may be, preferably formed from light metals, e.g. at least 1 mm, preferably at least 2 mm and up to e.g. 10 mm, preferably up to 6 or 4 mm. For steel, a value of usually about 40 to 75% of said values may be sufficient.

Figure 8:
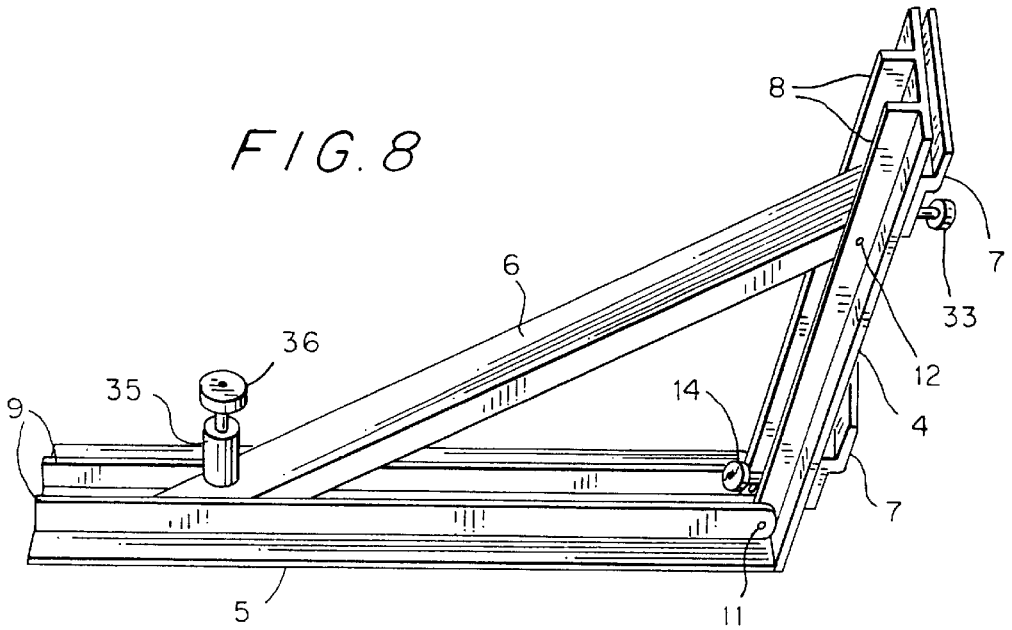
Figure 9:
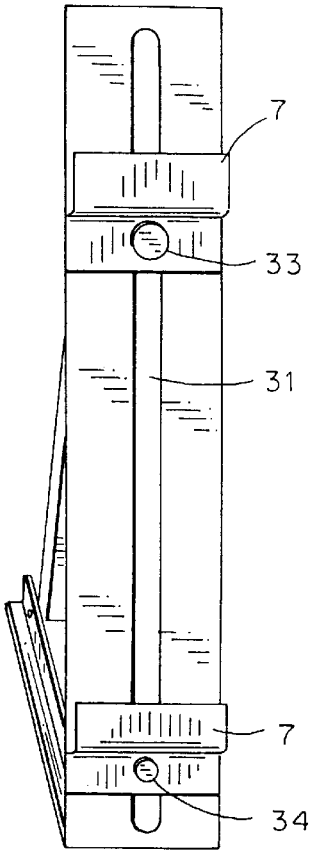
Figure 10:
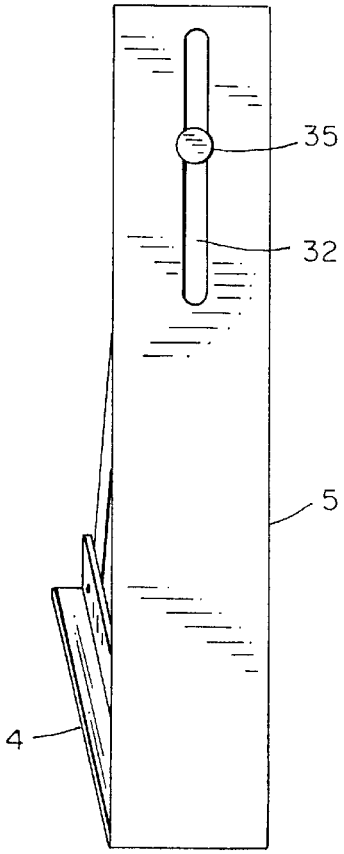
Figure 14:
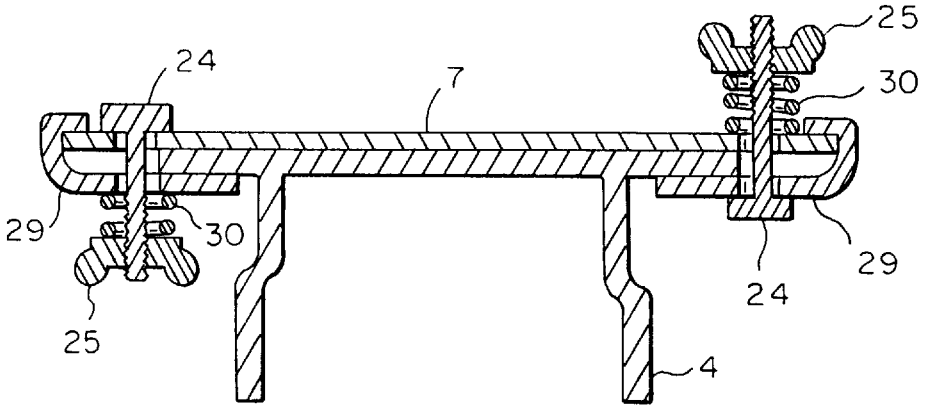
FIGS. 13 and 14 disclose embodiments of fastening means 7 and fastening thereof to the post 4.
Figure 13:
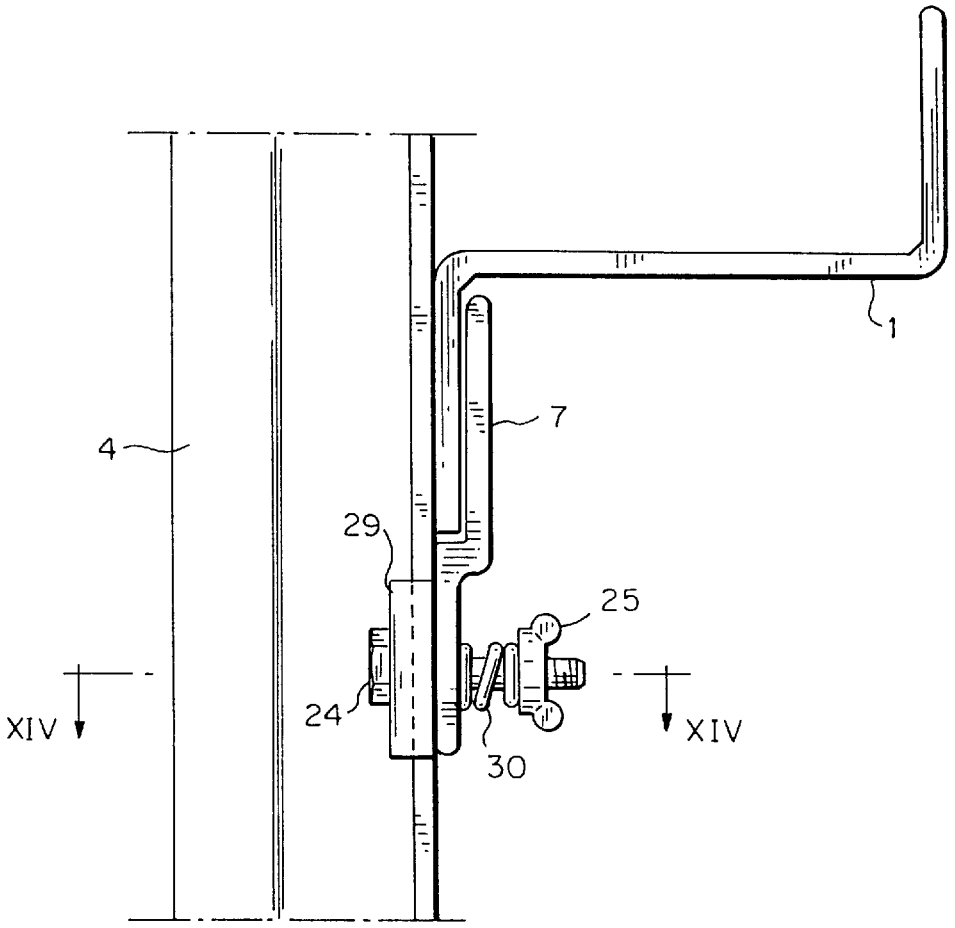

A suitable embodiment of a transverse support according to this invention is shown on FIGS. 8–10. According to said embodiment the post and the base part are made from elongated profile beams, preferably of light metal or steel, e.g. galvanized steel. The post and the base part are provided with flanges 8 and 9 resp. extending out in right angle to the side of the beam which is intended to face the mould or the base resp. and which preferably has a flat shape. The post and the base part are at one end thereof connected with a pivotable joint 11, e.g. with a bolt extending through openings in the flanges. A brace 6, preferably with a shape which fits in between the flanges 8, 9, is at 12 pivotably connected to the post, and is at its other end provided with an opening 35 for a bolt which extends through a slot 32 in the base part 5 so that the end of the brace can be locked in a desired position in the groove 32 with a locking nut 36 for setting a desired angle between the post and the base part, e.g. for compensating for the slope of a base or ground in case the post 4 shall extend in the vertical direction. The side of the post facing the mould, which is preferably flat, is provided with an elongated slot 31 through which bolts 33 extend for locking fastening means 7 for support beams in a desired position along the post with the aid of nuts 34, which preferably can be tightened without using tools.

Figure 2:
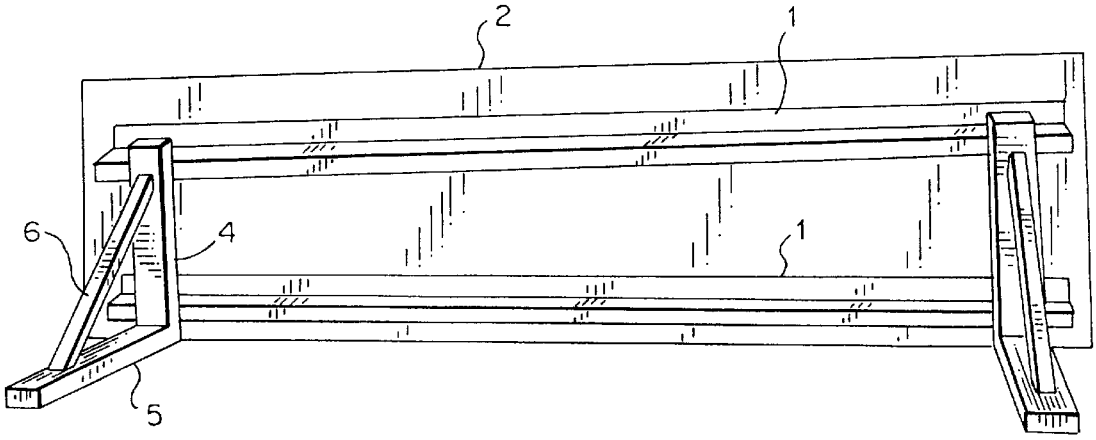
FIGS. 2 and 3 disclose the device according to FIG. 1 with a shuttering (form) panel 2 fastened to the support beams.
Figure 3:
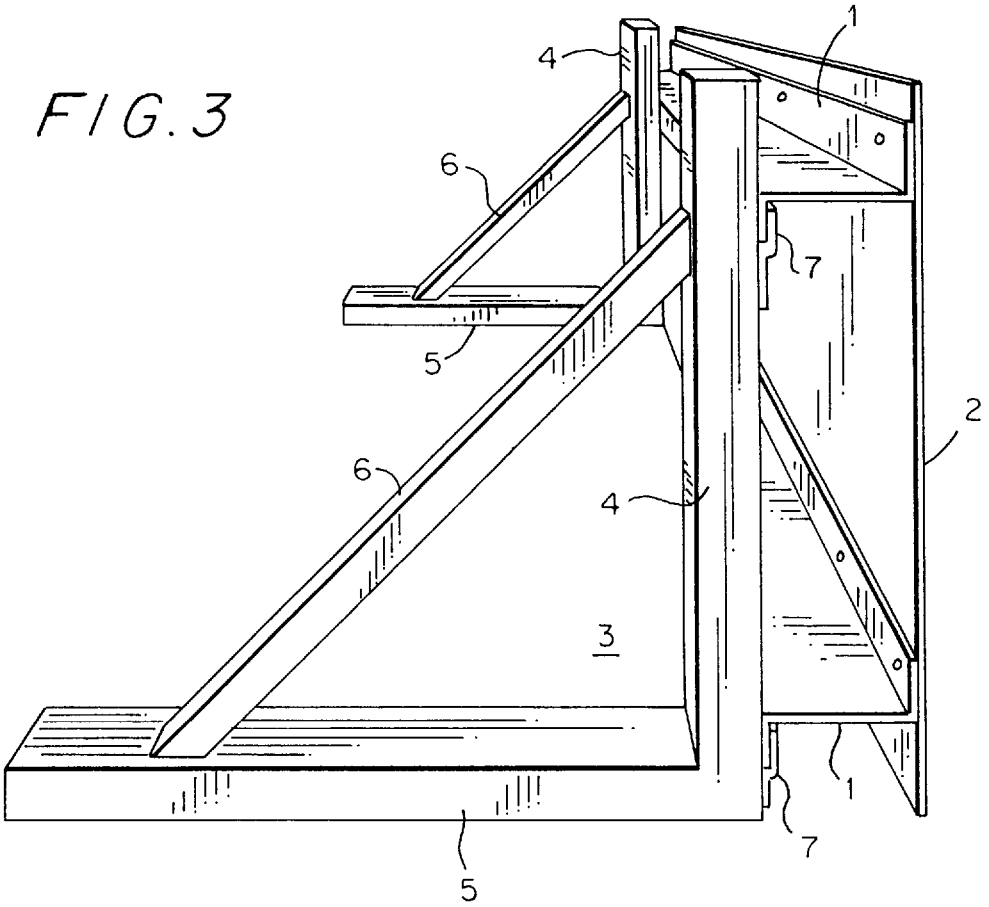
Figure 4:
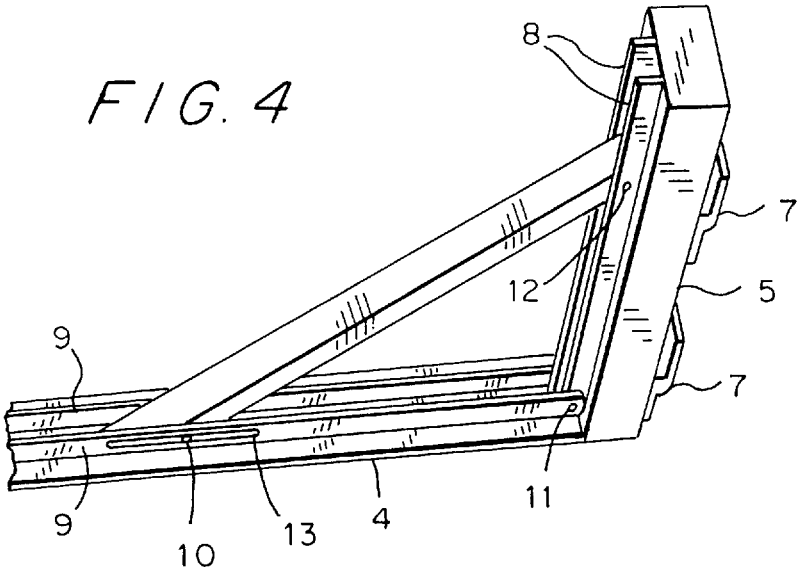
Figure 6:
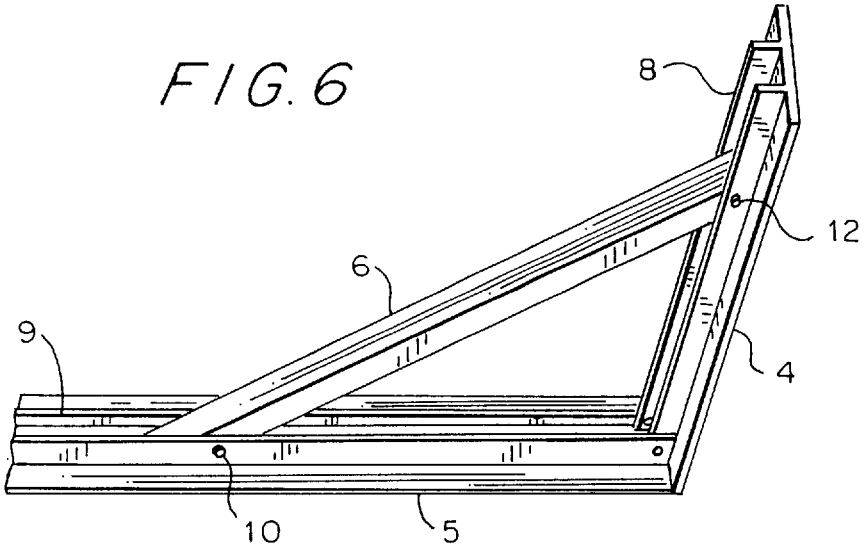
Figure 5:
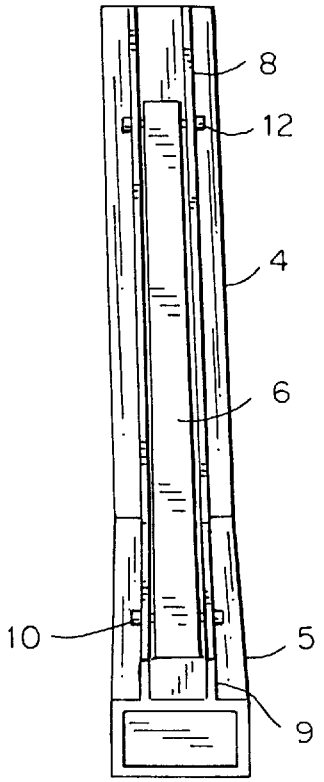
Figure 7:
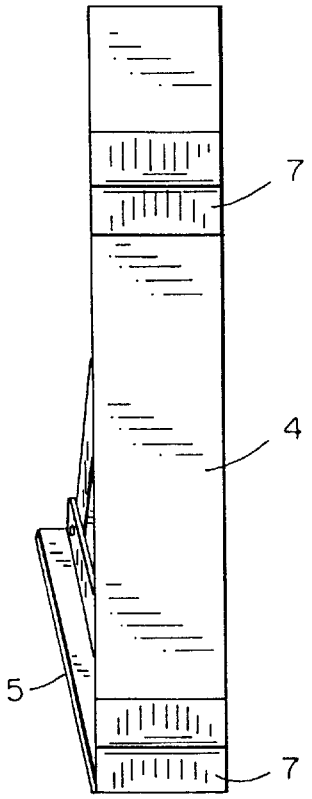
Figure 15:
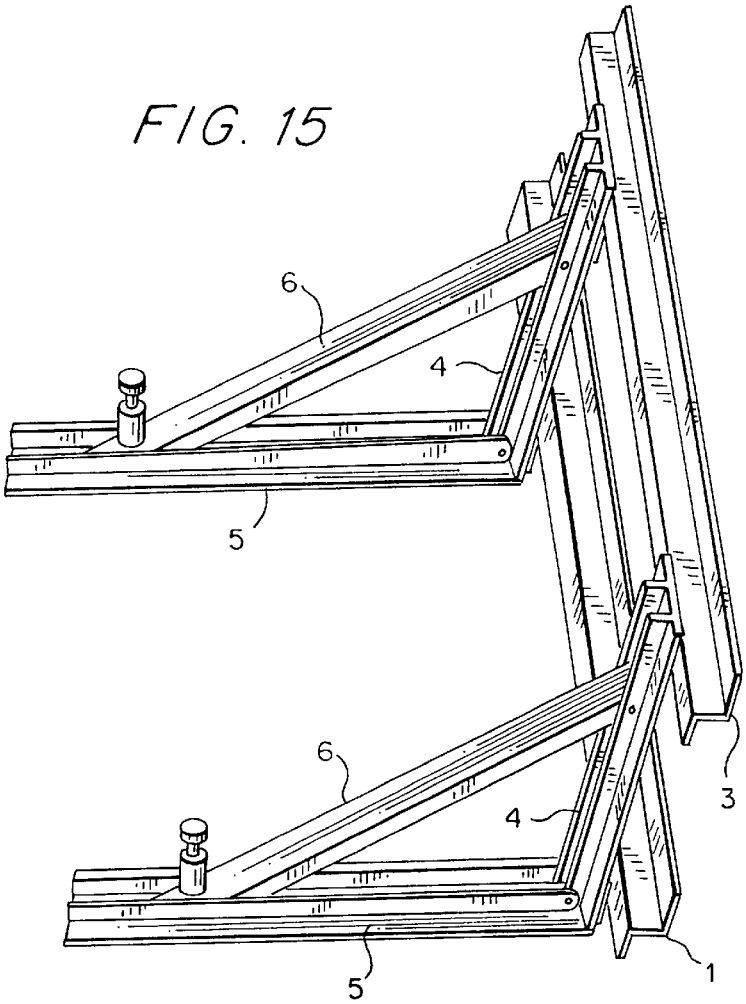
FIGS. 15 and 16 disclose mould support devices according to this invention with adjustable transverse supports according to FIGS. 8–10.
Figure 16:
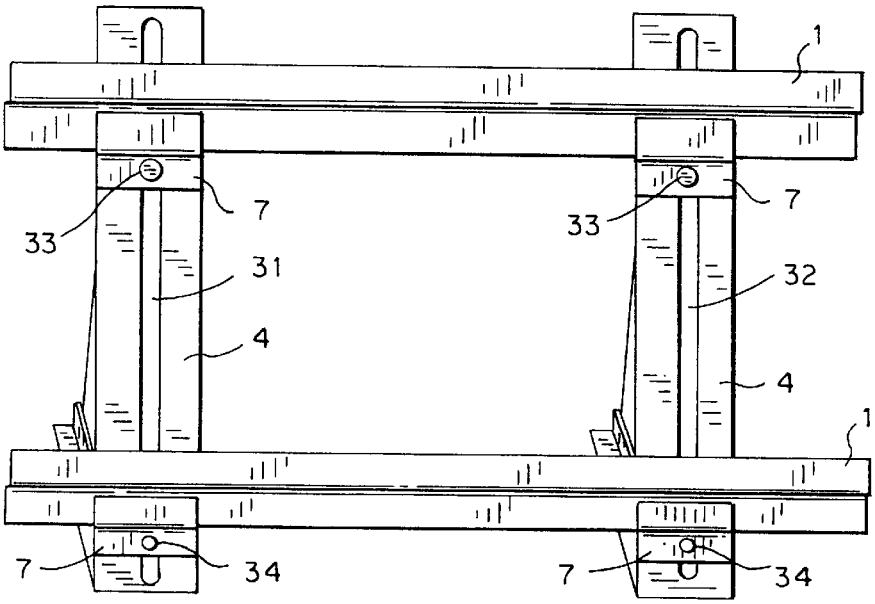

FIGS. 15 and 16 show how two transverse supports according to FIGS. 8–10 carry two support beams with Z-profile shape in the same way as is shown on FIGS. 1–3.

Figure 17:
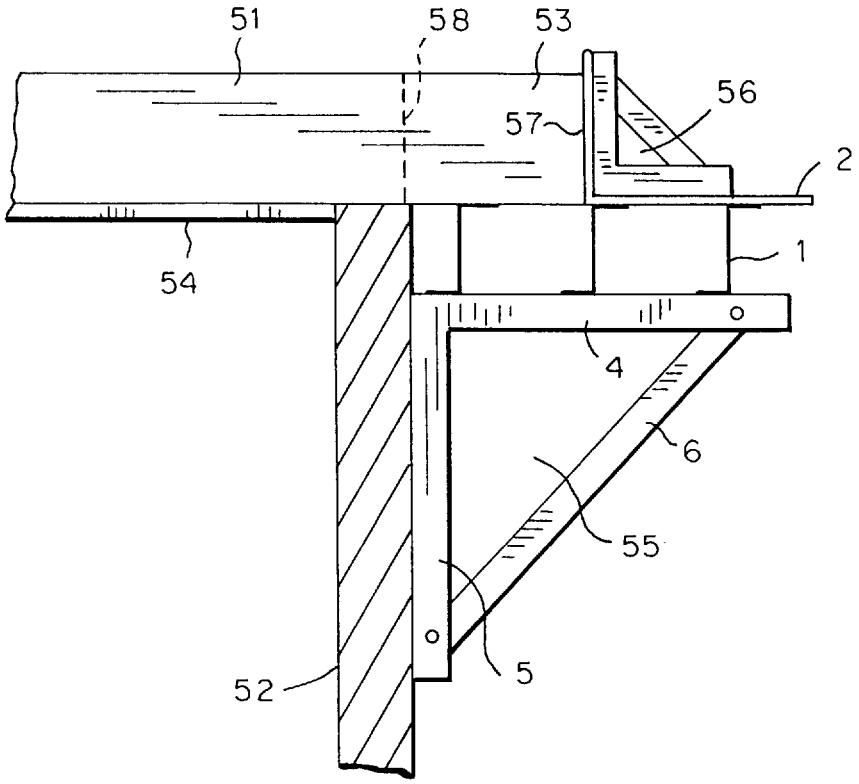
Figure 18:
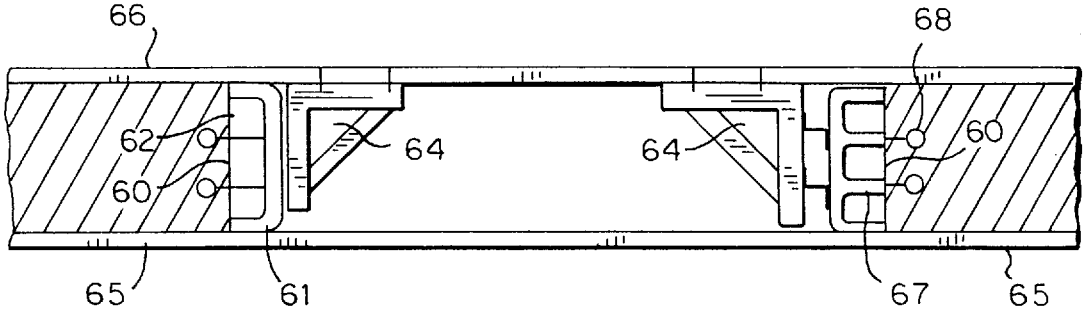
FIG. 18 discloses the use of window or door reveal elements as a mould surface in accordance with this invention.

FIG. 17 shows an embodiment according to which two transverse supports, whereof at least one preferably is a transverse support of the shape disclosed previously, are mutually interconnected so that a mould pressure exerted onto one of said transverse supports is transferred to the other transverse support and therefrom to a base or ground which carries the transverse support. Preferably the base part of that one of said transverse supports which carries the mould surface rests on a post part of the other transverse support, and the base part of said last-mentioned transverse support is carried on a pressure supporting base. FIG. 17 shows the base part 5 of a transverse support 55 fastened to a vertical wall 52 with bolts or similar means, the post 4 of said transverse support carrying a number of support beams 1 on which is arranged a panel 2 which partly forms a mould bottom surface for a protrusion 53 extending outwards from an arch 51 and which is moulded to the wall 52. On said panel (shuttering panel) 2 there are also arranged transverse supports 56 which may have fixedly connected legs (post and base part) or mutually pivotable such elements which can be set in a suitable angle to each other. At the transverse supports 56 there is arranged a shuttering panel 57 acting as an arch stop end. Alternatively the transverse support 55 may directly, without support beams, carry the shuttering panel 2, and casting can also be carried out so that the protrusion 53 is not formed, as is indicated with a hatched line 58 indicating the position of the shuttering panel 57 under such conditions, and in that case the transverse support 56 can be fastened directly to the transverse support 55.

FIG. 17 shows sketchy, with a section through a mould for casting a wall with a recess for a door or a window, the use of a window or door reveal element 60 with a shell of fibre concrete 61 and a core of isolating material 62 held with transverse supports 64 according to this invention between wall mould panels 65, 66, onto which the transverse supports can be fastened e.g. with bolts or screws. The figure also shows stiffening flanges 67 and loops 68 for fastening to a wall reinforcement which is arranged between the shuttering panels 65, 66. The reveal elements can be arranged directly on said transverse supports or on support beams carried by said transverse supports, or can alternatively be fastened in another way in said wall mould, e.g. to the wall reinforcement (reinforcement rods) as mentioned above. Said reveal elements preferably have the characteristics and the shape mentioned above.

The casting mould device according to this invention is preferably used for casting concrete with a mould of low height, as mentioned above, e.g. for base plates or bottom plates, column footings, columns, walls, lift wells, recesses for doors and windows, arches (roofs), and for arch stop ends, for a base and for a stop end for protrusions, preferably with a low height of up to 1 m and preferably up to 0.5 or 0.3 m, and for many similar purposes.

I claim:

1. A casting mould device for casting concrete comprising:

a plurality of transverse supports (3) with a substantially triangular shape, each of said plurality of transverse supports (3) having a post (4), a base part (5) and a brace part (6), said post (4), said base part (5) and said brace part (6) each being formed as a single unitary element which is non-extensible;

a first end of said post (4) being pivotally connected to a first end of said base part (5) by a pivot;

a first end of said brace part (6) being pivotably engaged on said post (4) and a second end of said brace part (6) being slidably engaged on said base part (5), said first end of said brace part (6) and said second end of said brace part (6) being respectively arranged to be locked to said post (4) and said base part (5) in a position for setting an angle between the post and the base part (5);

said angle being variable from a right angle between said post and said base part (5) in an arc around said pivot;

said plurality of transverse supports (3) supporting a mould space delimiting element (2) by support beams (1) engaged to said plurality of transverse supports (3) by fastening means (7);

each said base part (5) of said plurality of transverse supports (3) transferring pressure on said mould space delimiting element (2) to a base upon which each said base part (5) rests.

2. A device according to claim 1, wherein said post (4) has a first longitudinal slot, said base part (5) has a second longitudinal slot and said first end and said second end of said brace part (6) each respectively has a fastener slidably engaged in said first longitudinal slot and said second longitudinal slot.

3. A device according to claim 2, wherein each said fastener can be locked at a predetermined position in a corresponding slot.

4. A device according to claim 1, wherein the arc includes an angle of at least 15° on either side of said right angle.

5. A device according to claim 1, wherein the support beams have a Z-profile shape comprising two outer flanges and an intermediate flange connecting said outer flanges, said flanges together forming a Z-shape, one of said outer flanges being fastened to each post (4) of said plurality of transverse supports (3) and the other outer flange being fastened to said casting mould space delimiting element.

6. A device according to claim 5, wherein each said post of said plurality of transverse supports is provided with said fastening means for the support beams with a gap between said fastening means and each said post which is parallel to the post and into which one flange of said two outer flanges of each of the support beams is inserted.

7. A device according to claim 1, wherein the transverse supports holding the support beams, are connected to and supported by another set of transverse supports of substantially triangular shape each of said another set of transverse supports having another post and another base part which are connected to each other at one end thereof, and another brace part extending between said another post and said another base part, each said another base part of said another set of transverse supports being arranged to transfer the pressure of the concrete cast to a supporting base.

8. A device according to claim 1, wherein the post, base part and brace part of the transverse supports are made from steel.

9. A device according to claim 1, wherein the post, base part and brace part of the transverse supports are made from an aluminum alloy.

10. A casting mould device for casting concrete, comprising a plurality of transverse supports of substantially triangular shape, each of said transverse supports having a post which is pivotably connected to a first end of a base part at a first end of said post, a first end of a brace part pivotably connected to a second end of the post and a second end of the brace part slidably and pivotably connected in a slot along said base part, said second end of the brace part having means for locking the brace part in a desired position in said slot and fixing the post at a predetermined angle of at least 15° on at least one side of a vertical line to the base part, each said post being provided with fastening means arranged for holding a casting mould space delimiting element and taking up pressure exerted on said casting mould space delimiting element by concrete cast against said casting mould space delimiting element, and transferring said pressure onto the transverse supports from each said post to each said base part, said pressure also being transferred from each said post to each said base part through each said brace part extending therebetween, each said base part being provided with means for fastening the base part to a casting mould pressure supporting base, each said post and each base part comprising an elongated profile beam with a flat surface respectively facing the casting mould space delimiting element and the supporting base, wherein the post, the base part and the brace part are each formed as a single non-extensible unitary element.

* * * * *